US007005056B2

(12) United States Patent
Srinivasan et al.

(10) Patent No.: US 7,005,056 B2
(45) Date of Patent: Feb. 28, 2006

(54) METHOD FOR INHIBITING CORROSION OF ALLOYS EMPLOYING ELECTROCHEMISTRY

(75) Inventors: Rengaswamy Srinivasan, Ellicott City, MD (US); Hassan M. Saffarian, Silver Spring, MD (US); Stuart A. Fogel, Columbia, MD (US)

(73) Assignee: The Johns Hopkins University, Baltimore, MD (US)

( * ) Notice: Subject to any disclaimer, the term of this patent is extended or adjusted under 35 U.S.C. 154(b) by 126 days.

(21) Appl. No.: 10/343,867

(22) PCT Filed: Oct. 2, 2001

(86) PCT No.: PCT/US01/42427

§ 371 (c)(1),
(2), (4) Date: Feb. 4, 2003

(87) PCT Pub. No.: WO02/29134

PCT Pub. Date: Apr. 11, 2002

(65) Prior Publication Data

US 2004/0011659 A1 Jan. 22, 2004

Related U.S. Application Data

(60) Provisional application No. 60/237,901, filed on Oct. 4, 2000.

(51) Int. Cl.
*C25D 11/00* (2006.01)
*C23C 8/10* (2006.01)

(52) U.S. Cl. ..... 205/333; 205/323; 205/324; 205/320; 148/243; 148/272; 148/277; 148/284

(58) Field of Classification Search ..... 148/246, 148/272–273, 243, 277, 284; 205/261, 320, 205/323–333, 316
See application file for complete search history.

(56) References Cited

U.S. PATENT DOCUMENTS

| | | | | | |
|---|---|---|---|---|---|
| 3,973,998 | A | * | 8/1976 | Datta et al. | 148/274 |
| 3,996,115 | A | * | 12/1976 | Kessler | 205/316 |
| 4,614,569 | A | * | 9/1986 | Duruz et al. | 205/350 |
| 5,240,589 | A | * | 8/1993 | Bartak et al. | 205/321 |
| 5,332,488 | A | * | 7/1994 | Mitsuji | 205/181 |
| 6,022,425 | A | * | 2/2000 | Nelson et al. | 148/272 |
| 6,068,711 | A | * | 5/2000 | Lu et al. | 148/273 |
| 6,120,619 | A | * | 9/2000 | Goudiakas et al. | 148/271 |
| 6,190,780 | B1 | * | 2/2001 | Shoji et al. | 428/472 |
| 2003/0170526 | A1 | * | 9/2003 | Hodgson et al. | 429/34 |

FOREIGN PATENT DOCUMENTS

WO WO 00/22689 * 4/2000

OTHER PUBLICATIONS

H.S. Isaacs et al. The Electrochemical Response of Steel to the Presence of Dissolved Cerium. Journal of Electrochemical Society. vol. 138, No. 2, Feb. 1991, p. 390-393. The Electrochemial Society, Inc.*

* cited by examiner

*Primary Examiner*—Roy King
*Assistant Examiner*—Lois Zheng
(74) *Attorney, Agent, or Firm*—Francis A. Cooch

(57) ABSTRACT

A method for inhibiting corrosion, e.g., pitting corrosion, of alloys is provided. Particularly, the method comprises contacting at least a portion of a surface of the alloy with an aqueous solution comprising a salt of one or more rare earth elements selected from the group consisting of yttrium, gadolinium, cerium, europium, terbium, samarium, neodymium, praseodymium, lanthanum, holmium, ytterbium, dysprosium and erbium; and establishing a voltage differential between an anode comprising the alloy and a cathode in the solution at an effective level and for a sufficient period of time wherein a rare earth element oxide-containing coating is formed on the surface of the alloy to inhibit corrosion thereof.

20 Claims, 2 Drawing Sheets

Figure 2A

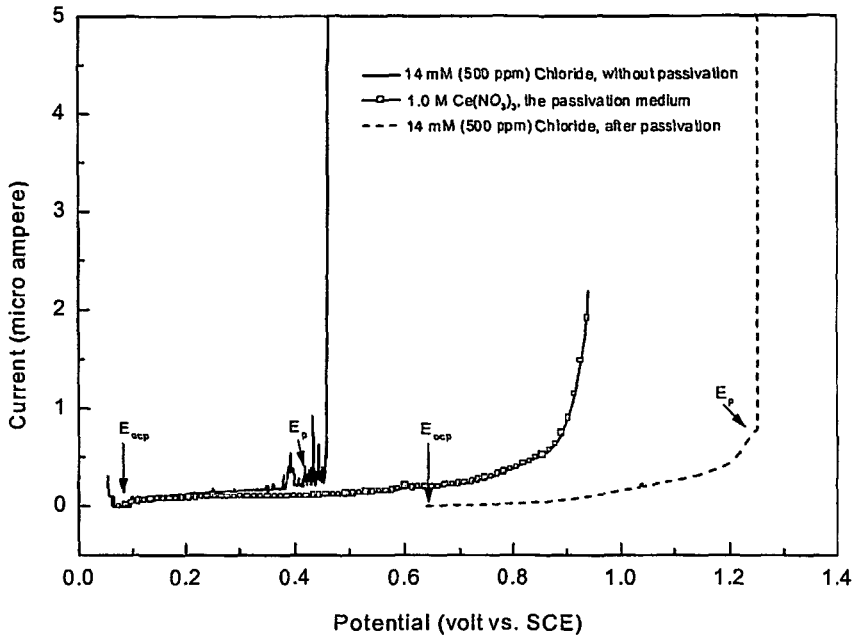

Figure 2B

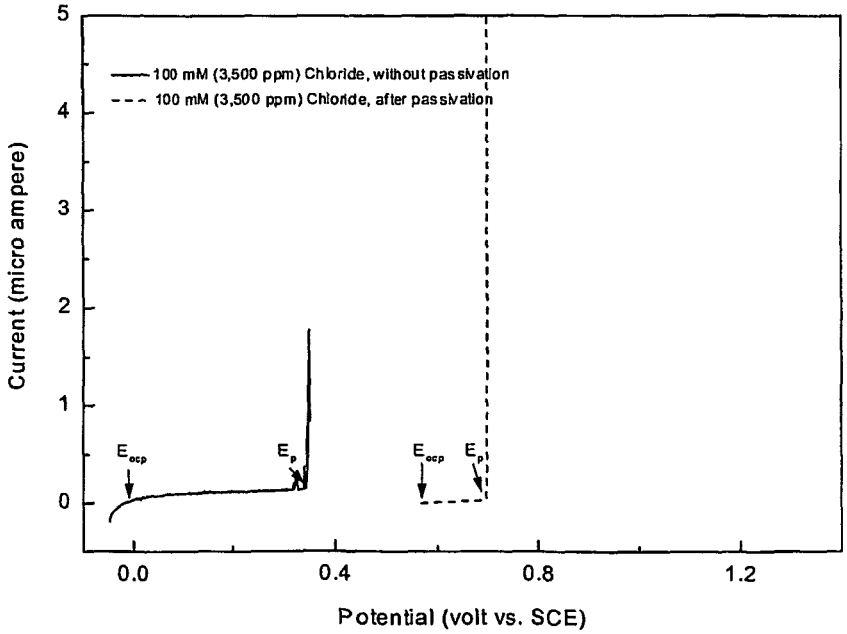

Figure 2: Tap water generally has less than 50 ppm chloride. Chloride concentration in brackish water and sweater may range from 3,500 to 35,000 ppm. The figure shows anodic polarization data for passivated and un- passivated 17-4 PH stainless steel electrodes in an aqueous solutions of sodium chloride: (A) In the middle is the anodic polarization curve of the alloy in an aqueous solution of 1.0 M cerium nitrate. On the left is the anodic polarization curve of the alloy in 500 ppm chloride solution before passivation. On the right is the anodic polarization curve of the alloy in 500 ppm chloride solution after passivation. Note that the passivatied alloy shows a 0.8 V increase in the pitting potential, $E_p$ (from 0.45 to 1.25 V), indicating that the cerium ions incorporated in the chromium oxide layer on the surface of the alloy has increased the resistance of the alloy to pitting corrosion. (B) Even when the chloride level is 3,500 ppm, the anodic passivation of the alloy in cerium nitrate increases $E_p$ by 0.4 V, which is a substantial increase in the resistance of the alloy to pitting corrosion.

METHOD FOR INHIBITING CORROSION OF ALLOYS EMPLOYING ELECTROCHEMISTRY

CROSS-REFERENCE TO RELATED APPLICATIONS

This application claims the benefit of prior filed, co-pending U.S. provisional application Ser. No. 60/237,901, filed on Oct. 4, 2000.

BACKGROUND OF THE INVENTION

1. Field of the Invention

The present disclosure relates generally to a method for inhibiting corrosion of alloys by surface treatment employing electrochemistry. More particularly, the present disclosure is directed to inhibiting the corrosion of alloys by treating the surface of the alloy with a salt of one or more elements of the rare earth group employing electrochemistry.

2. Description of the Related Art

In general, highly alloyed metals such as, for example, stainless steel alloys, are ordinarily utilized in environments subjected to corrosion conditions due to their resistance to pitting and crevice corrosion. Corrosion typically occurs in an environment where the alloys are in contact with an aqueous medium such as seawater, well water, saltwater and tap water contaminated with, for example, chloride. Examples of the various environments, where alloys are used include the off-shore industry (seawater, acid oil and gas), for heat exchangers and condensers (seawater), for desalination plants (saltwater), for flue-gas purification equipment (chloride-containing acids), for flue-gas condensing apparatus (strong acids), for plants for the production of sulphurous acid or phosphoric acid, for pipes and apparatus for oil and gas production (acid oil and gas), for apparatus and pipes in cellulose bleaching plants and in chlorate production plants (chloride containing, oxidizing acids or solutions, respectively) and for tankers and petrol trucks (all kinds of chemicals). The reason the stainless steel possesses such corrosion resistance is the high alloy content, which is believed to inhibit the corrosion processes. One such alloying element that provides the excellent corrosion resistance of these stainless steels is chromium because it forms a chromium oxide passive film on the surface of the steel. Other alloying elements, which also assist in improving the pitting corrosion resistance, are molybdenum and nickel.

Pitting corrosion is the first stage toward more serious forms of corrosion such as, for example, fatigue, stress corrosion cracking and hydrogen embrittlement in the alloy. Thus, it is important to inhibit pitting corrosion at the earliest stage possible. One way to enhance the corrosion resistance of alloys such as stainless steel alloys and, therefore, inhibit pitting corrosion is to dissolve corrosion inhibitors in the liquid that is in contact with the stainless steel structure. Another example to enhance the corrosion resistance is to add the corrosion inhibitors to a paint or polymer coating and then applying the paint or coating to the stainless steel structure.

Yet another example to increase the corrosion resistance of alloys is to provide a corrosion-resistant layer on the surface of the stainless steel alloy by incorporating cerium or other rare earth cations into the oxide film on the stainless steel's surface. This has been accomplished by immersing the steel into a solution of a cerium salt and water and then heating the solution to a high temperature. However, heating may not always be an option to incorporate the cerium and/or other rare earth ions on the surface of the alloy. For example, a structure made from the alloy may be part of an environment that may not tolerate heat or the water vapor that results from heating the solution containing rare earth salt. There may also not be a provision to capture the water vapor in an efficient manner. Accordingly, the surface of the alloy may lose its corrosion protection after a period of time resulting in an additional treatment of "corrosion proofing".

Thus, it would be desirable to increase the corrosion resistance of alloys such as stainless steel alloys by introducing a salt of one or more rare earth elements, e.g., cerium, into the surface of the alloy without having to perform a high temperature step. The electrochemical treatment described herein provides such a step that is free of high temperature heating.

SUMMARY OF THE INVENTION

It is an object of the present disclosure to provide a method for inhibiting the corrosion of alloys, particularly pitting corrosion, by treating the surface of the alloy with a salt of one or more elements of the rare earth group employing the step of the electrochemistry known in the art as electrochemical anodic passivation or anodization process.

It is another object of the present disclosure to provide a method for treating a surface of an alloy by exposing the surface to a salt of one or more elements of the rare earth group employing electrochemistry to increase the corrosion resistance of the alloy.

Yet another object of the present disclosure is to provide a method for inhibiting pitting and other forms of localized corrosion on alloys by treating a surface of the alloy with an aqueous solution comprising a salt of one or more elements of the rare earth group employing electrochemistry followed by adding a corrosion inhibiting surface active agent, e.g., a corrosion inhibiting surfactant, to the solution which is in contact with the alloy to increase the corrosion resistance of the alloy.

In keeping with these and other objects of the present disclosure, a method for inhibiting the corrosion of an alloy is provided which comprises the steps of:

i. contacting at least a portion of a surface of the alloy with an aqueous solution comprising a salt of one or more elements of the rare earth group; and ii. establishing a voltage differential between an anode comprising the alloy and a cathode in the solution at an effective level and for a sufficient period of time wherein a rare earth element oxide-containing coating is formed on the surface of the alloy to increase the corrosion resistance thereof.

Further in accordance with the present disclosure, a method for treating a surface of an alloy to increase the corrosion resistance thereof is provided which comprises the steps of:

i. contacting at least a portion of the surface with an aqueous solution comprising a salt of one or more elements of the rare earth group; and ii. establishing a voltage differential between an anode comprising the alloy and a cathode in the solution at an effective level and for a sufficient period of time wherein a rare earth element oxide-containing coating is formed on the surface of the alloy to increase the corrosion resistance thereof.

The expression "rare earth group" shall be used herein in its art recognized form, i.e., as referring to the lanthanide series of elements in the periodic table with atomic numbers ranging from cerium (58) to lutetium (71) inclusive. Lanthanum, yttrium and scandium, while not technically lanthanides because they do not have f-orbital electrons, are chemically very similar to the lanthanides and accordingly are also considered rare earth elements herein. The expression "rare earths" is used to refer to this particular group of rare earth elements both in chemical practice and hereinafter.

BRIEF DESCRIPTION OF THE DRAWINGS

A preferred embodiment of the method of the present disclosure is described below with reference to the drawings; which are set forth as follows:

FIG. 2 shows the aniodic polarization curves from the experimental results of an anodized and un-anodized 17-4 PH stainless steel in an aqueous solution sodium chloride.

DESCRIPTION OF THE PREFERRED EMBODIMENTS

Figure 1:
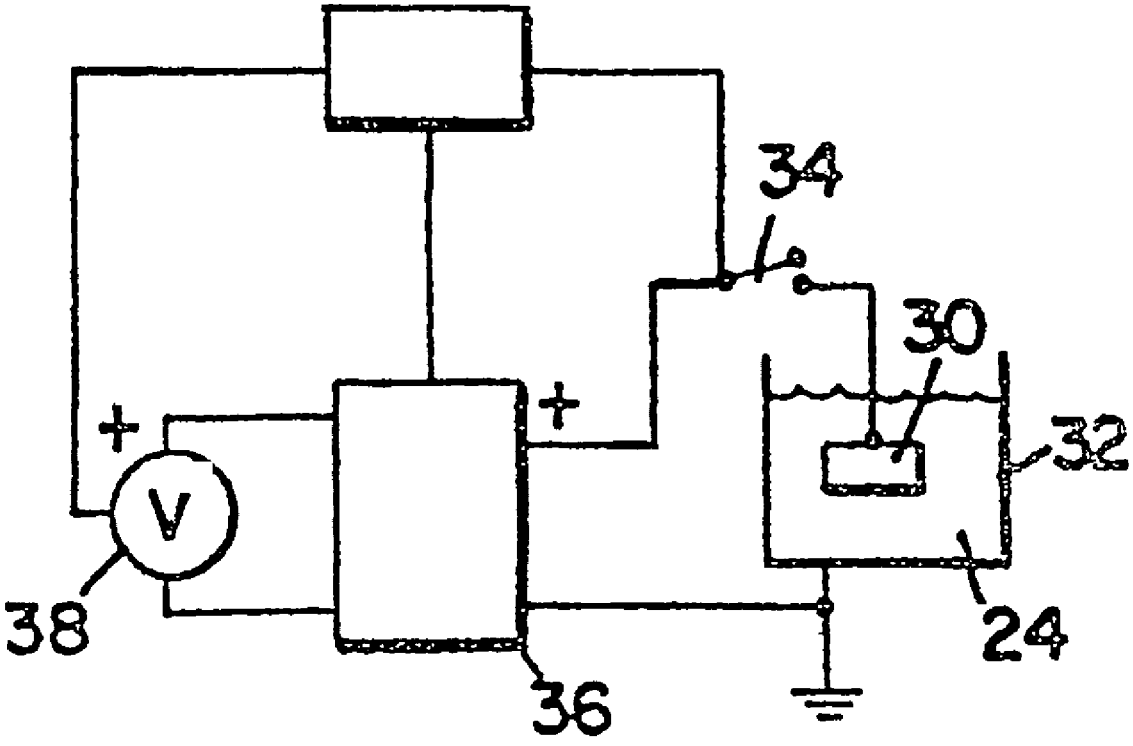
FIG. 1 is a diagram of the electrochemical method of the present disclosure.

The methods of this invention advantageously inhibit the corrosion of alloys, e.g., stainless steel alloys, and particularly the pitting and crevice corrosion of these alloys. Suitable alloys for use in the method of the present disclosure include, but are not limited to, any commercially available stainless steel alloy known to one skilled in the art, chromium-based alloys, nickel-based alloys, aluminum-based alloys, copper-based alloys and the like. For listings of stainless steel alloys and their chemical composition, see, e.g., Metals Handbook, "Property and Selection: Irons, Steels and High-Performance Alloys", Vol. 1, ASM International, page 843 (1990), the contents of which are incorporated by reference herein. Examples of the stainless steel alloys for use herein include, but are not limited to, 17-4 PH stainless steel, 304 stainless steel, 304L stainless steel, 316 stainless steel, 316L stainless steel, UNS S40900, UNS S41045, UNS 531603, UNS N08904, etc. Preferred alloys for use herein are the 17-4 PH and 316 stainless steel alloys.

As one skilled in the art will readily appreciate, the surface of the alloy will have an oxide layer thereon. Accordingly, to carry out the method of this invention, at least a portion of a surface of the foregoing alloys will be contacted with an aqueous solution and then subjecting the surface to an electrochemical step by creating a voltage differential between an anode and cathode for a sufficient period of time and at an effective power such that at least a portion of one or more of the rare earth salts implant in the surface of the alloy to increase the corrosion resistance thereof. The aqueous solution for use herein will contain at least a salt of at least one element of the rare earth group selected from the group consisting of yttrium, gadolinium, cerium, europium, terbium, samarium, neodymium, praseodymium, lanthanum, holmium, ytterbium, dysprosium, and erbium. The salts will typically be dissolved in a suitable liquid medium e.g., water. A preferred aqueous solution for use herein is a cerium salt, e.g. cerium sulfate, cerium nitrate, etc., dissolved in water.

Concentration of the rare earth element salt(s) in the aqueous solution will vary widely according to the alloy being treated. Generally, a concentration of the rare earth element salt will range in an amount sufficient to advantageously implant in the surface of the alloy during the electrochemical step such that the corrosion resistance of alloy will be significantly improved. The concentration of the rare earth salt will ordinarily range from about 1 mM to about 1.5 M, preferably from about 0.1 M to about 1.2 M and most preferably from about 0.5 M to about 1 M. The aqueous solution is advantageously kept at ambient temperature to allow for minimum evaporation of water and to avoid unnecessary heating of the structure that is being treated or its environment.

If desired, the aqueous solution can also contain a sulfate. Useful sulfates include, but are not limited to, alkali metal sulfates such as, for example, sodium sulfate, potassium sulfate, etc. Preferably the sulfate is sodium sulfate.

The alloy to be treated will be contacted with the aqueous solution by techniques known in the art such that at least a portion of a surface of the alloy is in contact with the solution. Suitable techniques include, but are not limited to, immersion, dispersing, spraying and the like. The use of an aqueous solution advantageously allows full access to the surface area of any piece of work in need of corrosion protection. However, it will be understood that other methods may be used, such as, for example, sputtering, plasma spraying and the like, such that the rare earth elements are deposited on the alloy surface. Those skilled in the art will be able to determine the operative processing conditions for each of the deposition procedures. The preferred technique for use herein is immersing at least a portion of the alloy in need of corrosion protection in a bath of the aqueous solution.

Once the alloy is contacted with the aqueous solution, e.g., by way of immersion in a vessel containing a bath of the aqueous solution, the alloy is then subjected to electrochemical processing steps to implant the rare earth element(s) into at least a portion of the oxide layer on the surface of the alloy and provide a rare earth element oxide-containing coating on the surface of the alloy. Referring now to FIG. 1, the alloy 30 will act as an anode after being immersed in the aqueous solution 24. The vessel 32 which contains the aqueous solution 24 may be used as the cathode. Suitable vessels for use herein as a cathode are known in the art and include, for example, a stainless steel vessel. The anode may be connected through a switch 34 to a rectifier 36 while the vessel 32 may be directly connected to the rectifier 36. The rectifier 36, rectifies the voltage from a voltage source 38, to provide a direct current source to the aqueous solution. Preferably, the rectifier provides a pulsed DC signal to drive the deposition process.

The current will flow through the aqueous solution at an effective level and for a time period sufficient to implant the rare earth element(s) into at least a portion of the oxide layer on the surface of the alloy and provide a rare earth element oxide-containing coating on the surface of the alloy. For example, in the case of a stainless steel chromium alloy, by flowing the current through the aqueous solution with the stainless steel alloy immersed therein, the current will advantageously dissolve at least a portion of the oxide layer formed on the surface of the alloy. However, the chromium present in the oxide layer on the surface of the alloy is insoluble and will precipitate back onto the surface of the alloy. At this point, the rare earth element(s) will replace and implant in the voids remaining in the oxide layer on the surface of the alloy, in amounts comparable to the amount of chromium in the oxide layer, to provide the rare earth element oxide-containing coating on the surface of the alloy and increasing the corrosion protection of the resulting alloy. Thus, for this to occur a voltage differential between the anode comprising the alloy and the cathode in the solution is established by flowing a current not exceeding a current density of 10 $\mu A/cm^2$ through the solution. Generally, the current will flow through the solution such that the current density will range from about 0.1 $\mu A/cm^2$ to about 2.5 $\mu A/cm^2$, preferably from about 0.25 $\mu A/cm^2$ to about 2.0 $\mu A/cm^2$ and most preferably from about 0.5 $\mu A/cm^2$ to about 1.0 $\mu A/cm^2$. The time period sufficient to provide the increased corrosion protection of alloy can range from about 10 minutes to about 120 minutes and preferably from about 50 minutes to about 60 minutes. During the course of the anodization process, it is important to ensure the electrochemical potential of the anode (i.e., the alloy) remains within the potential range that is commonly known in the art as the "passivation potential".

If desired, a corrosion inhibiting surface active agent may be added to the aqueous solution following the step of electrochemistry to further increase the corrosion resistance of the alloys. Suitable corrosion inhibiting surface active agents include, but are not limited to, corrosion inhibiting surfactants, e.g., sodium lauryl sulfate. The solution will ordinarily contain from about 0.01 to about 0.05 weight percent of the surfactant.

After the alloys have been subjected to the method disclosed herein, they may be used as is, offering excellent corrosion resistant properties, or they may be coated using an optional finish coating such as paint or a sealant. The optional finish coatings may include inorganic and organic compositions as well as paints and other decorative and protective organic coatings. Any paint, which adheres well to metallic surfaces, may be used as the optional finish coating. Representative, non-limiting inorganic compositions for use as an outer coating include alkali metal silicates, phosphates, borates, molydates and vanadates. Representative, non-limiting organic outer coatings include polymers such as polyfluoroethylene, polyurethane and polyglycol. Additional finish coating materials will be known to those skilled in the art. Again, these optional finish coatings are not necessary to obtain excellent corrosion resistance, their use may achieve decorative or further improve the protective qualities of the coating.

Referring now to FIG. 2, the X-axis represents the electrochemical potential of 17-4 PH stainless steel immersed in an aqueous solution contained in a glass beaker connected to a potentiostat/galvanostat. The 17-4 PH stainless steel was connected to the working electrode terminal ("$W_e$") of the potentiostat/galvanostat. A platinum wire served as the cathode and was connected to the counter electrode terminal ("$C_e$") of the potentiostat/galvanostat. The saturated calomel electrode ("SCE") was also immersed in the solution and connected to the reference electrode terminal ("$R_e$") of the potentiostat/galvanostat. The Y-axis represents the current flowing through the solution at various potentials. The point $E_{ocp}$ represents the open circuit potential ("OCP") that the alloy assumes when it is immersed in an aqueous solution containing salt(s), and no voltage differential is impressed between the alloy and the cathode. Once the voltage differential is impressed, a small, but measurable current passes through the aqueous solution. Next, if the voltage differential is increased, the current may not show a concomitant increase, unless the alloy begins to pit or corrode in other fashion. The point $E_p$ in the figure represents the potential at which there is a sudden increase in the current, which is caused by the process of pitting corrosion of the alloy. In the art, $E_p$ is known as the pitting potential. Also, in the art, it is known that smaller the $E_p$ the higher the probability that the alloy undergoing pitting in that medium. The potential region in between $E_{ocp}$ and $E_p$ is known in the art as the "passivation potential" region.

FIG. 2 shows three curves. The one in the middle corresponds to the passivation treatment of the alloy in an aqueous solution of 1.0 M cerium (III) nitrate, i.e., $Ce(NO_3)_3$, where the alloy was passivated by "scanning" the potential under potentiodynamic conditions from its $E_{ocp}$ to 1.2 V at the rate of 10 mV/minute and then passing a current of 7 microampere/$cm^2$ under galvanostatic conditions for a period of 60 minutes. The curve on the extreme right corresponds to the anodic polarization curve of the passivated alloy in 14 mM (500 ppm) chloride solution. The curve on the extreme left corresponds to the anodic polarization curve of alloy before passivation (or without passivation) in 14 mM (500 ppm) chloride solution. Note that after passivation, the $E_p$ has increased from 0.45 to 1.25 V (measured against the SCE). It is believed that such an increase in $E_p$ is due to the incorporation of cerium into the chromium oxide layer on the surface of the 17-4 PH.

It will be understood that various modifications may be made to the embodiments disclosed herein. Therefore the above description should not be construed as limiting, but merely as exemplifications of preferred embodiments. For example, the functions described above and implemented as the best mode for operating the present invention are for illustration purposes only. Other arrangements and methods may be implemented by those skilled in the art without departing from the scope and spirit of this invention. Moreover, those skilled in the art will envision other modifications within the scope and spirit of the claims appended hereto.

What is claimed:

1. A method for inhibiting the corrosion of an alloy comprising the steps of:

contacting at least a portion of a surface of the alloy with an aqueous solution, the aqueous solution comprising a salt of at least one element of the rare earth group selected from the group consisting of yttrium, gadolinium, cerium, europium, terbium, samarium, neodymium, praseodymium, lanthanum, holmium, ytterbium, dysprosium, erbium and combinations thereof; and establishing a voltage differential between an anode comprising the alloy and a cathode in the solution at an effective level and for a sufficient period of time wherein a rare earth element oxide-containing coating is formed on the surface of the alloy;

wherein the effective level of the voltage differential is established by flowing a current not exceeding a current density of about 10 $\mu A/cm^2$.

2. The method of claim 1 wherein the alloy is a stainless steel alloy.

3. The method of claim 2 wherein the stainless steel alloy is selected from the group consisting of 17-4 PH stainless steel, 304 stainless steel, 304L stainless steel, 316 stainless steel, 316L stainless steel, UNS S40900, UNS S41045, UNS 531603 and UNS N08904.

4. The method of claim 1 wherein the alloy is a stainless steel alloy containing chromium.

5. The method of claim 4 wherein the stainless steel alloy containing chromium is 17-4 PH stainless steel or 316 stainless steel.

6. The method of claim 5 wherein the aqueous solution further comprises sodium sulfate or potassium sulfate.

7. The method of claim 1 further comprising connecting the anode and cathode to a power source.

8. The method of claim 7 wherein the power source is a rectified alternating current power source.

9. The method of claim 8 wherein the rectified alternating current power source is a pulsed full wave rectified power source.

10. The method of claim 1 further comprising adding a corrosion inhibiting surfactant to the aqueous solution following the step of establishing a voltage differential.

11. The method of claim 10 wherein the surfactant is sodium lauryl sulfate.

12. A method for inhibiting the corrosion of an alloy comprising the steps of:

contacting at least a portion of a surface of the alloy with an aqueous solution, the aqueous solution comprising a salt of at least one element of the rare earth group selected from the group consisting of yttrium, gadolinium, cerium, europium, terbium, samarium, neodymium, praseodymium, lanthanum, holmium, ytterbium, dysprosium, erbium and combinations thereof; and establishing a voltage differential between an anode comprising the alloy and a cathode in the solution at an effective level and for a sufficient period of time wherein a rare earth element oxide-containing coating is formed on the surface of the alloy;

wherein the aqueous solution comprises the salt of one or more of the rare earth group elements dissolved in water; and wherein the effective level of the voltage differential is established by flowing a current having a current density from about 0.1 $\mu A/cm^2$ to about 2.5 $\mu A/cm^2$ for a time period from about 10 minutes to about 120 minutes.

13. A method for inhibiting the corrosion of an alloy comprising the steps of:

contacting at least a portion of a surface of the alloy with an aqueous solution, the aqueous solution comprising a salt of at least one element of the rare earth group selected from the group consisting of yttrium, gadolinium, cerium, europium, terbium, samarium, neodymium, praseodymium, lanthanum, holmium, ytterbium, dysprosium, erbium and combinations thereof; and establishing a voltage differential between an anode comprising the alloy and a cathode in the solution at an effective level and for a sufficient period of time wherein a rare earth element oxide-containing coating is formed on the surface of the alloy;

wherein the salt is a nitrate and the rare earth element is selected from the group consisting of cerium, gadolinium, neodymium, praseodymium, lanthanum and combinations thereof; and wherein the effective level of the voltage differential is established by flowing a current having a current density from about 0.1 $\mu A/cm^2$ to about 2.5 $\mu A/cm^2$ for a time period from about 10 minutes to about 120 minutes.

14. A method for inhibiting the corrosion of an alloy comprising the steps of:

contacting at least a portion of a surface of the alloy with an aqueous solution, the aqueous solution comprising a salt of at least one element of the rare earth group selected from the group consisting of yttrium, gadolinium, cerium, europium, terbium, samarium, neodymium, praseodymium, lanthanum, holmium, ytterbium, dysprosium, erbium and combinations thereof; and establishing a voltage differential between an anode comprising the alloy and a cathode in the solution at an effective level and for a sufficient period of time wherein a rare earth element oxide-containing coating is formed on the surface of the alloy;

wherein the salt is a sulfate and the rare earth element is selected from the group consisting of cerium, gadolinium, neodymium, praseodymium, lanthanum and combinations thereof; and wherein the effective level of the voltage differential is established by flowing a current having a current density from about 0.1 $\mu A/cm^2$ to about 2.5 $\mu A/cm^2$ for a time period from about 10 minutes to about 120 minutes.

15. A method for inhibiting the corrosion of an alloy comprising the steps of:

contacting at least a portion of a surface of the alloy with an aqueous solution, the aqueous solution comprising a salt of at least one element of the rare earth group selected from the group consisting of yttrium, gadolinium, cerium, europium, terbium, samarium, neodymium, praseodymium, lanthanum, holmium, ytterbium, dysprosium, erbium and combinations thereof; and establishing a voltage differential between an anode comprising the alloy and a cathode in the solution at an effective level and for a sufficient period of time wherein a rare earth element oxide-containing coating is formed on the surface of the alloy;

wherein the aqueous solution comprises the salt of one or more of the rare earth group elements dissolved in water wherein the salt is a nitrate and the rare earth element is cerium; and wherein the effective level of the voltage differential is established by flowing a current having a current density from about 0.1 $\mu A/cm^2$ to about 2.5 $\mu A/cm^2$ for a time period from about 10 minutes to about 120 minutes.

16. A method for inhibiting the corrosion of a stainless steel alloy comprising the steps of:

contacting at least a portion of a surface of the alloy with an aqueous solution, the aqueous solution comprising a salt of at least one element of the rare earth group selected from the group consisting of yttrium, gadolinium, cerium, europium, terbium, samarium, neodymium, praseodymium, lanthanum, holmium, ytterbium, dysprosium, erbium and combinations thereof; and establishing a voltage differential between an anode comprising the alloy and a cathode in the solution at an effective level and for a sufficient period of time wherein a rare earth element oxide-containing coating is formed on the surface of the alloy;

wherein the effective level of the voltage differential is established by flowing a current not exceeding a current density of about 10 $\mu A/cm^2$.

17. The method of claim 16 wherein the stainless steel alloy is selected from the group consisting of 17-4 PH stainless steel, 304 stainless steel, 304L stainless steel, 316 stainless steel, 316L stainless steel, UNS S40900, UNS S41045, UNS 531603 and UNS N08904.

18. A method for inhibiting the corrosion of a stainless steel alloy comprising the steps of:

contacting at least a portion of a surface of the alloy with an aqueous solution, the aqueous solution comprising a salt of at least one element of the rare earth group selected from the group consisting of yttrium, gadolinium, cerium, europium, terbium, samarium, neodymium, praseodymium, lanthanum, holmium, ytterbium, dysprosium, erbium and combinations thereof; and establishing a voltage differential between an anode comprising the alloy and a cathode in the solution at an effective level and for a sufficient period of time wherein a rare earth element oxide-containing coating is formed on the surface of the alloy;

wherein the aqueous solution comprises the salt of the one or morn rare earth group elements dissolved in water; and wherein the effective level of the voltage differential is established by flowing a current having a current density from about 0.1 $\mu A/cm^2$ to about 2.5 $\mu A/cm^2$ for a time period from about 10 minutes to about 120 minutes.

19. A method for inhibiting the corrosion of a stainless steel alloy comprising the steps of:

contacting at least a portion of a surface of the alloy with an aqueous solution, the aqueous solution comprising a salt of at least one element of the rare earth group selected from the group consisting of yttrium, gadolinium, cerium, europium, terbium, samarium, neodymium, praseodymium, lanthanum, holmium, ytterbium, dysprosium, erbium and combinations thereof; and establishing a voltage differential between an anode comprising the alloy and a cathode in the solution at an effective level and for a sufficient period of time wherein a rare earth element oxide-containing coating is formed on the surface of the alloy;

wherein the salt is a nitrate and the rare earth element is selected from the group consisting of cerium, gadolinium, neodymium, praseodymium, lanthanum and combinations thereof; and wherein the voltage differential is established by flowing a current having a current density from about 0.1 $\mu A/cm^2$ to about 2.5 $\mu A/cm^2$ for a time period from about 10 minutes to about 120 minutes.

20. A method for inhibiting the corrosion of a stainless steel alloy comprising the steps of:

contacting at least a portion of a surface of the alloy with an aqueous solution, the aqueous solution comprising a salt of at least one element of the rare earth group selected from the group consisting of yttrium, gadolinium, cerium, europium, terbium, samarium, neodymium, praseodymium, lanthanum, holmium, ytterbium, dysprosium, erbium and combinations thereof; and establishing a voltage differential between an anode comprising the alloy and a cathode in the solution at an effective level and for a sufficient period of time wherein a rare earth element oxide-containing coating is formed on the surface of the alloy;

wherein the salt is a sulfate and the rare earth element is selected from the group consisting of cerium, gadolinium, neodymium, praseodymium, lanthanum and combinations thereof; and wherein the effective level of the voltage differential is established by flowing a current having a current density from about 0.1 $\mu A/cm^2$ to about 2.5 $\mu A/cm^2$ for a time period from about 10 minutes to about 120 minutes.

* * * * *

UNITED STATES PATENT AND TRADEMARK OFFICE

CERTIFICATE OF CORRECTION

PATENT NO. : 7,005,056 B2
APPLICATION NO. : 10/343867
DATED : February 28, 2006
INVENTOR(S) : Rengaswamy Srinivasan et al.

It is certified that error appears in the above-identified patent and that said Letters Patent is hereby corrected as shown below:

Column 1, between lines 10 and 11 insert the following:

-- Statement of Government Interest
This invention was made with Government support under Department of the Navy contract N00024-98-D-8124.
The Government has certain rights in the invention. --

Signed and Sealed this

Fourth Day of March, 2008

JON W. DUDAS
*Director of the United States Patent and Trademark Office*